US006192654B1

(12) United States Patent
Georgitsis et al.

(10) Patent No.: US 6,192,654 B1
(45) Date of Patent: Feb. 27, 2001

(54) ROTARY CONVEYOR WITH RECEPTACLES FOR PACKETS OF THE TOBACCO PROCESSING INDUSTRY

(75) Inventors: Nikolaos Georgitsis; Jens Collin, both of Hamburg (DE)

(73) Assignee: Topack Verpackungstechnik GmbH, Schwarzenbek (DE)

( * ) Notice: Subject to any disclaimer, the term of this patent is extended or adjusted under 35 U.S.C. 154(b) by 0 days.

(21) Appl. No.: 09/030,758

(22) Filed: Feb. 25, 1998

(30) Foreign Application Priority Data

Mar. 27, 1997 (DE) ..... 197 12 912

(51) Int. Cl.[7] ..... B65B 11/06
(52) U.S. Cl. ..... 53/234; 53/225; 53/228
(58) Field of Search ..... 53/234, 225, 228; 493/134, 332, 265

(56) References Cited

U.S. PATENT DOCUMENTS

| | | | |
|---|---|---|---|
| 2,855,977 | 10/1958 | Wagner | 154/42 |
| 4,179,864 | 12/1979 | Focke | 53/388 |
| 4,196,560 | 4/1980 | Seragnoli | 53/53 |
| 5,190,141 | 3/1993 | Boldrini et al. | 198/689.2 |

FOREIGN PATENT DOCUMENTS

| | | |
|---|---|---|
| 195 17 131 A1 | 11/1995 | (DE) . |
| 0 726 435 A1 | 2/1996 | (EP) . |
| 1212415 | 11/1970 | (GB) . |

*Primary Examiner*—Joseph J. Hail, III
(74) *Attorney, Agent, or Firm*—Venable; George H. Spencer; Catherine M. Voorhees

(57) ABSTRACT

A wheel-shaped conveyor with radially extending pockets for discrete packets of cigarettes is indexible about a horizontal axis between the neighboring surfaces of two upright walls forming part of a support for the conveyor and flanking a selected portion of an arcuate path for successive packets in the respective pockets of the conveyor. The upright walls have orifices which direct streamlets of compressed air against the adjacent sidewalls of the packets advancing along the selected portion of the path so that the streamlets of air can promote setting of the freshly applied adhesive between the panels of those sidewalls of the packets which advance along the respective upright walls of the support. The streamlets of air establish cushions of air between the moving sidewalls of the packets and the stationary walls of the support to thus reduce the likelihood of defacing and/or otherwise damaging the sidewalls.

11 Claims, 2 Drawing Sheets

ROTARY CONVEYOR WITH RECEPTACLES FOR PACKETS OF THE TOBACCO PROCESSING INDUSTRY

BACKGROUND OF THE INVENTION

The invention relates to apparatus for treating selected sections or regions of various commodities with a gaseus fluid. More particularly, the invention relates to improvements in apparatus which can be utilized with advantage for the treatment of packets containing arrays of plain or filter cigarettes or other products of the tobacco processing industry. Still more particularly, the invention relates to improvements in apparatus wherein a rotary (such as indexible) conveyor is provided with pockets or other types of receptacles for commodities which should be treated by air or another gaseous fluid, for example, to avoid a defacing and/or other damage during transport along a predetermined path, e.g., for the purpose of effecting a setting of freshly applied films of adhesive.

It is known to transfer block-shaped (such as brick-shaped) packets, wherein arrays of, for example, twenty plain or filter cigarettes or other types of rod-shaped smokers' products are confined in so-called hinged-lid containers from a first conveyor (e.g., an endless belt or chain conveyor which advances freshly converted blanks of cardboard or the like past one or more adhesive applicators of the type known as pasters) into the pockets of a second conveyor wherein the freshly applied adhesive is expected to set, e.g., to reliably bond overlapping panels of sidewalls of successive containers to each other. The first conveyor can receive arrays of cigarettes or the like from a further conveyor wherein or whereon the arrays are confined in converted blanks of metallic foil or the like to form with such converted blanks a succession of brick-shaped assemblies ready to be confined in suitably configurated blanks which consist of cardboard or plastic sheet material and are folded and/or otherwise treated during conversion into hinged-lid containers surrounding the aforementioned assemblies. Certain overalapping panels of the containers are bonded to each other by a suitable adhesive which must be allowed to set while the mutually inclined and/or overlapping walls, flaps, tucks and other constituents of the freshly formed containers (packets) are held against any appreciable movement relative to each other in order to ensure that successive packets of a short or long series of packets will be imparted with identical sizes and identical shapes. All such operations must be carried out at an extremely high speed if a packing machine is to process the output of at least one modern high-speed cigarette making or filter tipping machine.

The next step in the making of customary packets of for example twenty elongated rod-shaped smokers' products each can involve confining successive packets in transparent outer envelopes of cellophane or another suitable wrapping material; such transparent envelopes are often provided with conventional tear strips serving to facilitate rapid removal of an outer envelope in order to afford access to the hinged lid of the packet.

OBJECTS OF THE INVENTION

An object of the invention is to provide a novel and improved apparatus wherein successive commodities (such as hinged-lid packets containing arrays of cigarettes or the like) can be treated with a gaseous fluid in a novel and improved way.

Another object of the invention is to provide an apparatus which can promote the setting of adhesive serving to secure certain overlapping panels (such as walls, flaps and/or tucks) of hinged-lid packets or analogous commodities to each other.

A further object of the invention is to provide an apparatus which, in addition to enhancing the setting of one or more films of an adhesive substance, can also serve to prevent defacing of and/or other damage to successive commodities in the course of transport through one or more stations where the film or films of adhesive are to set in a predictable and time-saving manner.

An additional object of the invention is to provide a novel and improved support for a rotary conveyor in a cigarette packing or an analogous machine.

Still another object of the invention is to provide an apparatus which can subject hinged-lid packets or analogous commodities to one or more beneficial treatments in a small area and at a high frequency.

A further object of the invention is to provide a novel and improved method of assembling and processing a series of successive packets containing arrays of plain or filter cigarettes or other products of the tobacco processing industry.

An additional object of the invention is to provide a novel and improved method of simultaneously (a) enhancing the stability and (b) preventing deformation or defacing of block-shaped commodities of the tobacco processing industry.

SUMMARY OF THE INVENTION

One feature of the present invention resides in the provision of an apparatus for treating selected sections of commodities with a gaseous fluid, for example, for treating films of adhesive between overlapping panels of hinged-lid packets with compressed atmospheric air. The improved apparatus comprises a support and a conveyor which is mounted in the support and has receptacles (e.g., in the form of pockets) for discrete commodities. The conveyor is rotatable (e.g., indexible) relative to the support to advance commodities in their receptacles along a predetermined path including a portion wherein the selected sections of the commodities advance along at least one portion of the support. The at least one portion of the support has openings arranged to direct gaseous fluid against each selected section of a commodity in the aforementioned portion of the path.

As a rule, the support is stationary, and such stationary support can include two components which flank the aforementioned portion of the path; the openings are provided in at least one of these components. It is often preferred to provide openings in each of the two components and the openings of each such component can be arranged to direct a pressurized gaseous fluid against one of two discrete sections of a commodity in the aforementioned portion of the path.

As already mentioned hereinbefore, the commodities can constitute substantially brick- or block-shaped packets for smokers' products, and each such packet can include elongated adhesive-carrying sidewalls. Each such sidewall constitutes one selected section of the respective packet, and the gaseous fluid is directed against the selected sections of commodities in the aforementioned portion of the path in a condition (e.g., at a predetermined temperature or having a predetermined moisture content) which is effective to promote a setting of the adhesive.

The openings can constitute gas-discharging orifices or ports or bores communicating with the receptacle in the aforementioned portion of the path for the receptacles of the rotary conveyor. The apparatus can further comprise a fluid-containing plenum chamber which is adjacent the support and communicates with at least some of the orifices.

The conveyor can be mounted in the support for rotation about a predetermined axis, and the support can include two discs which flank the aforementioned portion of the path. The centers of the discs can be located at (e.g., exactly on) the predetermined axis, and each such disc can be provided with a set of openings arranged to direct gaseous fluid against a discrete section of a commodity in that receptacle which advances along the aforementioned portion of the path. The predetermined axis can be horizontal or nearly horizontal, and each of the two discs can be provided with a surface which confronts the aforementioned portion of the path. The openings of the discs have discharge ends in their respective surfaces. The conveyor can include or constitute a wheel and its receptacles can include pockets which are provided in the peripheral surface of the wheel and extend at least substantially radially of the predetermined axis all the way between the two end surfaces of the wheel.

Each commodity can include a packet having a pair of at least substantially parallel sidewalls each constituting a discrete section of the respective commodity. The stationary support of an apparatus for treating such commodities can include two spaced-apart components which flank the aforementioned portion of the path, and each such component has a surface adjacent the aforementioned portion of the path. The openings have discharge ends provided in the surfaces of the two components and serve to discharge streams of a compressed gaseous fluid against the sidewalls of the packet in the aforementioned portion of the path. The openings in each of the two components are preferably distributed at least in the direction of advancement of commodities along the predetermined path.

The novel features which are considered as characteristic of the invention are set forth in particular in the appended claims. The improved apparatus itself, however, both as to its construction and the mode of assembling and utilizing the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
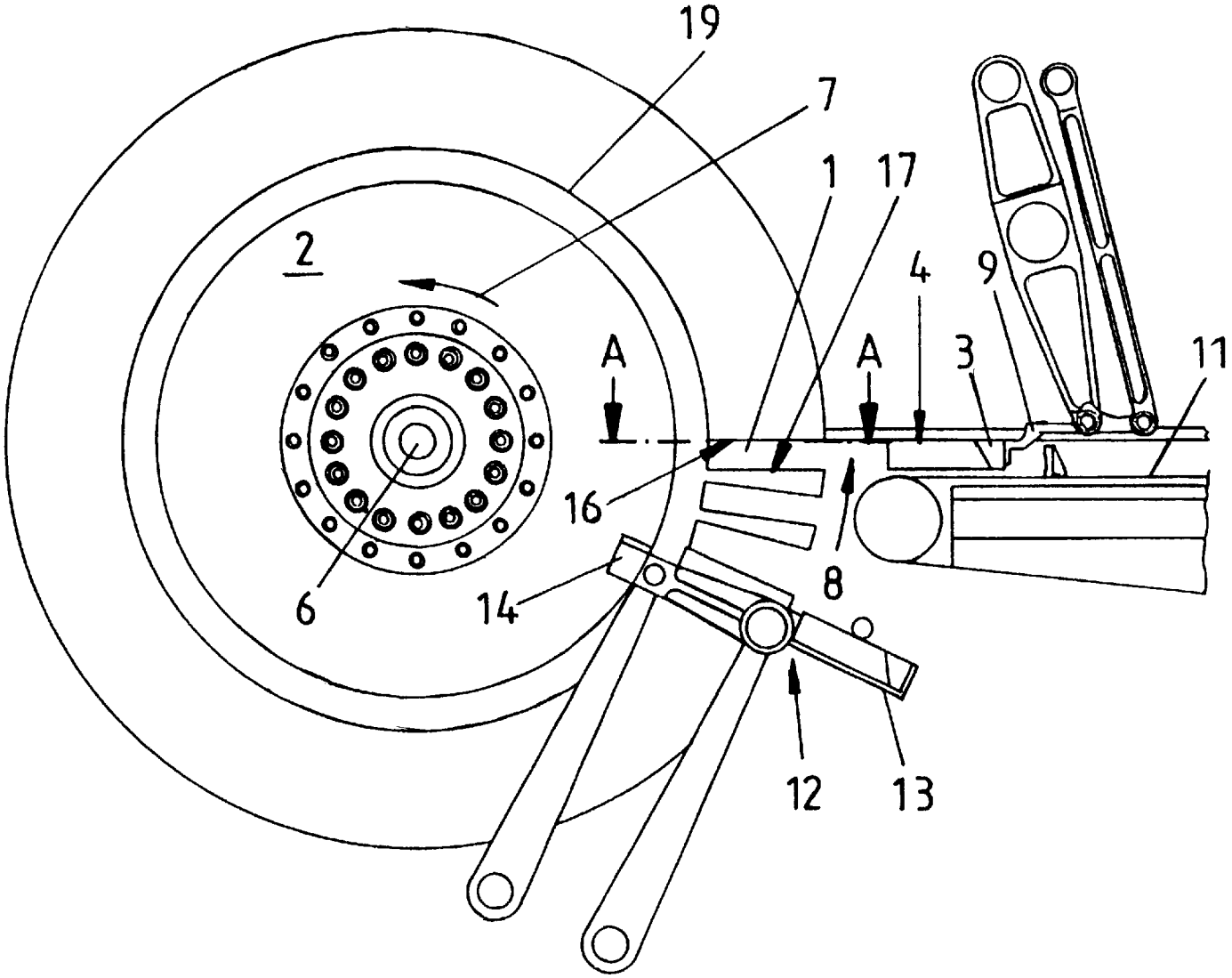
FIG. 1 is a side elevational view of an apparatus which utilizes a rotary conveyor and the improved support therefor.
Figure 2:
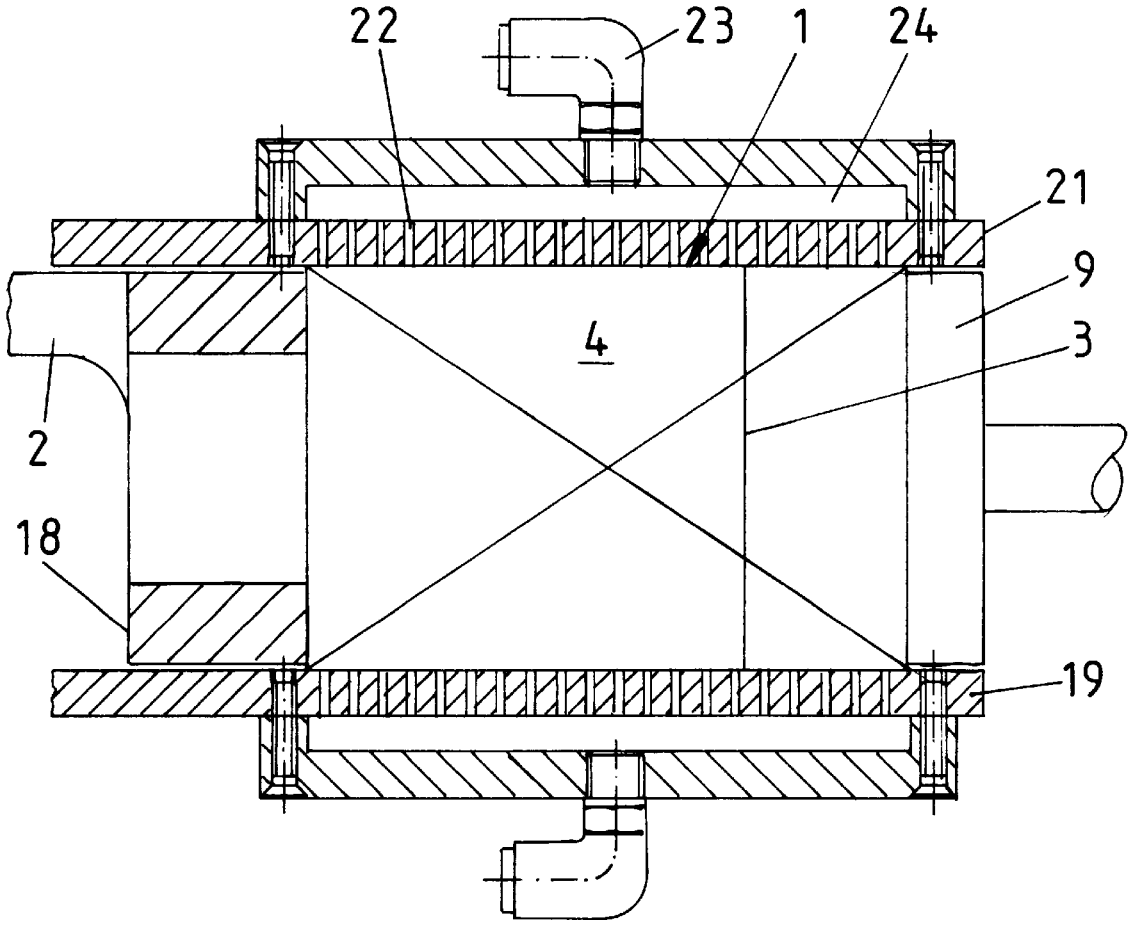
FIG. 2 is an enlarged fragmentary horizontal sectional view substantially as seen in the direction of arrows from the line A—A in FIG. 1.

The apparatus which is shown in FIGS. 1 and 2 comprises a wheel-shaped rotary conveyor 2 which is indexible (counterclockwise, as viewed in FIG. 1 and as indicated by an arrow 7) about the horizontal axis of a shaft 6 and journalled in two spaced-apart disc-shaped components 19, 21 of a stationary housing or support for the conveyor 2. The peripheral surface of the conveyor 2 is provided with a set of equidistant radially inwardly extending receptacles 1 in the form of pockets which extend toward but well short of the axis of the shaft 6 and all the way (see FIG. 2) between the adjacent upright surfaces of the stationary components 19, 21 of the support.

The commodities 4 which are treated by streamlets of compressed air issuing from the openings or orifices 22 in the components 19, 21 of the support are block- or brick-shaped packets of the type known as hinged-lid packets. Each such packet is assumed to contain a block-shaped array of, for example, twenty parallel plain or filter cigarettes in an inner envelope of metallic foil or the like.

FIG. 1 shows a receiving station 8 where a reciprocable pusher 9 serves to transfer successive packets 4 from an endless or other suitable conveyor 11 into successive receptacles or pockets 1 of the intermittently driven wheel-shaped conveyor 2. The orientation of the packets 4 which are about to enter successive pockets 1 at the receiving station 8 is such that the hinged lids 3 are disposed at the trailing ends of the respective packets and are engaged and advanced by the pusher 9. As a rule, the two sidewalls of a hinged-lid packet 4 (namely the elongated sidewalls which face toward and away from the observer of FIG. 1) are assembled of pairs of overlapping panels of cardboard or the like, and such panels are caused to adhere to each other in response to the application of a film of a suitable adhesive between them. The purpose of the novel apparatus is to promote rapid setting of such adhesive while the packets 4 advance in the respective pockets 1 of the conveyor 2 along an arcuate path (in the direction indicated by the arrow 7). Such path has a portion which is located between the disc-shaped components 19, 21 of the stationary support carrying the horizontal shaft 6 for the conveyor 2.

In many presently known hinged-lid packets, each sidewall includes two pairs of overlapping panels, namely a first pair forming part of the lid 3 and a second pair forming part of the remaining (major) portion of the packet.

When a packet 4 is properly received in its pocket 1, the bottom wall of such packet (namely the wall remote from the lid 3) is located in the radially innermost portion of the respective pocket and the two adhesive-carrying sidewalls of such packet are adjacent the two open sides of the respective pocket. This ensures that, when a packet 4 is caused to advance along that portion of its arcuate path which is located between the components or walls 19, 21 of the stationary support, the two composite (multilayer) sidewalls of such packet can be acted upon by jets or streamlets of compressed air issuing from the discharge ends of the openings or orifices 22 in the walls 19, 21.

The path for the treatment of packets 4 during travel in the pockets 1 of the conveyor 2 extends along an arc of nearly 360°, namely from the receiving station 8 to an evacuating or expelling station 12 where a reciprocable pusher 14 performs a succession of working strokes to expel freshly treated packets 4 from the respective pockets 1 during the intervals of dwell of the intermittently driven conveyor 2. The fully expelled packets 4 are intercepted by a further conveyor 13 which delivers such packets to a wrapping station (not shown) where the packets are confined in customary transparent outer envelopes (e.g., envelopes made of cellophane) which may but need not be provided with tear strips.

The conveyor 2 may be heated to promote the setting of adhesive layers between the overlapping panels of the sidewalls of each packet 4 advancing along the aforementioned path in the direction of the arrow 7. Such setting of the adhesive films can be promoted in any other suitable manner, e.g., by appropriate conditioning (such as heating and/or demoisturizing) of streamlets of gaseous fluid (normally air) which are caused to issue from the discharge ends of the openings, 22 in the components 19 and 21 of the stationary support.

It is important to ensure that the configuration of the packets 4 does not change during advancement in the pockets 1 of the conveyor 2. To this end, the surfaces 16, 17 and the wall 18 bounding the pockets 1 are configurated and dimensioned in such a way that they ensure proper positioning of the adjacent (front, rear and bottom) walls or panels of the packets 4 in the respective pockets 1.

The openings 22 in the components 19, 21 receive compressed air from two plenum chambers 24 which are or which can be connected to a common source of such air by suitable supply conduits 23. The streamlets or jets of air issuing from the two groups of openings 22 preferably serve the additional desirable function of establishing thin layers or cushions of air between the exposed sides of the lateral walls of the packets 4 and the adjacent upright surfaces of the components 19, 21. Thus, the packets 4 need not come into actual contact with the stationary support for the conveyor 2 which greatly reduces the likelihood of defacing and/or otherwise adversely affecting the appearance and/or shape of the packets 4 in thir pockets 1. For example, the cushions of air which develop at the discharge ends of the openings 22 prevent the development of scuff marks which can develop if the lateral panels (sidewalls) of the moving packets 4 are permitted to actually contact the stationary components 19, 21 of the support for the conveyor 2.

The openings 22 are preferably distributed in the direction of advancement of the packets 4, i.e., in the direction of the arrow 7 and along that portion of their path which extends between the components 19 and 21. As can be seen in FIG. 2, the distribution of the openings 22 is such that they can direct streamlets of air against the entire sidewalls of the adjacent packets 4, namely at least substantially all the way between the open radially outer ends of the pockets 1 and the wall 18 at the radially inner ends of such pockets.

A further advantage of the improved apparatus is that it can form part of, or that it can constitute, the means for conveying successive packets 4 from the conveyor 11 (which can transport arrays of rod-shaped smokers' products past the station where such arrays are draped into inner envelopes of metallic foil or the like) to a conveyor (such as 13) which transports the packets 4 toward and through a station where the hinged-lid containers of the packets are confined in transparent outer envelopes.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of treating packets in the receptacles of a rotary conveyor and, therefore, such adaptations should and are intended to be comprehended within the meaning and range of equivalence of the appended claims.

What is claimed is:

1. Apparatus for treating selected selections of commodities with a gaseous fluid, comprising a support having two components flanking a portion of a predetermined path; and a conveyor mounted in said support and having receptacles for receiving discrete commodities, said conveyor being rotatable relative to said support to advance commodities in said receptacles along the predetermined path including a portion wherein the selected sections of the commodities advance along at least one portion of said support, said at least one portion of said support having openings in said components arranged to direct gaseous fluid against each selected section of a commodity in said portion of said path, said commodities being substantially brick-shaped packets for smokers' products and each packet including elongated adhesive-carrying sidewalls, each sidewall constituting one selected section of the respective packet and the gaseous fluid being directed against said selected sections of packets in said portion of said path in a condition which is effective to promote a setting of the adhesive.

2. The apparatus of claim 1, wherein said support is stationary.

3. The apparatus of claim 2, wherein each of said components has openings arranged to direct a pressurized gaseous fluid against one of two discrete sections of a commodity in said portion of said path.

4. The apparatus of claim 1, wherein the gaseous fluid is compressed air.

5. The apparatus of claim 1, wherein said openings are gas-discharging orifices communicating with the receptacle in said portion of said path.

6. The apparatus of claim 5, further comprising at least one fluid-containing plenum chamber adjacent said support and communicating with at least some of said orifices.

7. The apparatus of claim 1, wherein said conveyor is rotatable about a predetermined axis and said support includes two discs flanking said portion of said path, said discs having centers located at said axis and each of said discs being provided with a set of openings arranged to direct gaseous fluid against a discrete section of a commodity in that receptacle which advances along said portion of said path.

8. The apparatus of claim 7, wherein said axis is at least substantially horizontal and each of said discs has a surface confronting said portion of said path, said openings having discharge ends in the surfaces of the respective discs.

9. The apparatus of claim 8, wherein said conveyor includes a wheel and said receptacles include pockets provided in a peripheral surface of said wheel and extending at least substantially radially of said axis.

10. The apparatus of claim 1, wherein each of the commodities includes a packet having a pair of at least substantially parallel sidewalls each constituting a discrete section of the respective commodity, said support being stationary and including two spaced-apart components flanking said portion of said path, each of said components having a surface adjacent said portion of said path and said openings having discharge ends provided in said surfaces of said components to discharge streams of compressed gaseous fluid against the sidewalls of the packet in said portion of said path.

11. The apparatus of claim 10, wherein the openings in each of said components are distributed at least in a direction of advancement of commodities along said path.

* * * * *